US008600087B2

(12) United States Patent
Fischer

(10) Patent No.: US 8,600,087 B2
(45) Date of Patent: Dec. 3, 2013

(54) HEARING APPARATUS AND METHOD FOR REDUCING AN INTERFERENCE NOISE FOR A HEARING APPARATUS

(75) Inventor: Eghart Fischer, Schwabach (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 913 days.

(21) Appl. No.: 12/716,372

(22) Filed: Mar. 3, 2010

(65) Prior Publication Data

US 2010/0226515 A1 Sep. 9, 2010

(30) Foreign Application Priority Data

Mar. 6, 2009 (DE) ..... 10 2009 012 166

(51) Int. Cl.
*H04R 25/00* (2006.01)

(52) U.S. Cl.
USPC ..... 381/317; 381/71.1; 381/94.1; 704/226; 704/233

(58) Field of Classification Search
USPC ..... 381/94.1, 71.2, 73.1, 74, 94.2, 94.7, 381/94.8, 370, 317, 94.3, 94.5, 71.14, 92, 381/312, 318; 704/226, 228, 233, E15.015, 704/E15.039, E21.002, E21.004, E21.008, 704/E21.014, E21.003, 225, 227, 270, 271
See application file for complete search history.

(56) References Cited

U.S. PATENT DOCUMENTS

| | | | | |
|---|---|---|---|---|
| 4,508,940 | A * | 4/1985 | Steeger | 381/317 |
| 5,524,056 | A * | 6/1996 | Killion et al. | 381/314 |
| 5,754,665 | A | 5/1998 | Hosoi | |
| 6,519,559 | B1 * | 2/2003 | Sirivara | 704/227 |
| 6,603,858 | B1 | 8/2003 | Raicevich et al. | |
| 6,751,325 | B1 | 6/2004 | Fischer | |
| 7,302,387 | B2 * | 11/2007 | Li et al. | 704/223 |
| 8,411,993 | B2 * | 4/2013 | Hamada et al. | 382/275 |
| 2001/0026178 | A1 * | 10/2001 | Itoh et al. | 327/112 |
| 2004/0258255 | A1 * | 12/2004 | Zhang et al. | 381/92 |
| 2006/0120540 | A1 | 6/2006 | Luo | |
| 2007/0041602 | A1 * | 2/2007 | Killion | 381/322 |
| 2007/0150268 | A1 * | 6/2007 | Acero et al. | 704/226 |
| 2009/0220107 | A1 * | 9/2009 | Every et al. | 381/94.7 |

FOREIGN PATENT DOCUMENTS

| | | | |
|---|---|---|---|
| DE | 19944467 | A1 | 3/2001 |
| EP | 0883325 | A2 | 12/1998 |

* cited by examiner

*Primary Examiner* — Vivian Chin
*Assistant Examiner* — Friedrich W Fahnert
(74) *Attorney, Agent, or Firm* — Laurence A. Greenberg; Werner H. Stemer; Ralph E. Locher

(57) ABSTRACT

A noise reduction is provided for a hearing apparatus, with which both stationary and also non-stationary interference noises can be attenuated in an input signal. An output signal is in this way to convey a quite sound impression. A signal processing is provided, which effects a noise reduction on the basis of two different methods. Provision is made on the one hand for a noise reduction for stationary interference noises and on the other hand for a noise reduction for spatially oriented interference noises. A selection facility selects between the two noise reductions.

6 Claims, 3 Drawing Sheets

HEARING APPARATUS AND METHOD FOR REDUCING AN INTERFERENCE NOISE FOR A HEARING APPARATUS

CROSS-REFERENCE TO RELATED APPLICATION

This application claims the priority, under 35 U.S.C. §119, of German application DE 10 2009 012 166.8, filed Mar. 6, 2009; the prior application is herewith incorporated by reference in its entirety.

BACKGROUND OF THE INVENTION

Field of the Invention

The invention relates to a hearing apparatus and a method for reducing an interference noise for a hearing apparatus. The term hearing apparatus is understood here to mean in particular a hearing device. The term also refers to other wearable acoustic devices such as headsets, headphones and suchlike.

Hearing devices are wearable hearing apparatuses which are used to supply the hard-of-hearing. To accommodate the numerous individual requirements, different configurations of hearing devices such as behind-the-ear hearing devices (BTE), hearing device with an external receiver (RIC: receiver in the canal) and in-the-ear hearing devices (ITE), e.g. also concha hearing devices or canal hearing devices (ITE—in-the-ear, CIC—completely in the canal) are provided. The hearing devices given by way of example are worn on the outer ear or in the auditory canal. Furthermore, bone conduction hearing aids, implantable or vibrotactile hearing aids are also available on the market. In such cases the damaged hearing is stimulated either mechanically or electrically.

Essential components of the hearing devices include in principal an input converter, an amplifier and an output converter. The input converter is generally a recording transducer, e.g. a microphone and/or an electromagnetic receiver, e.g. an induction coil. The output converter is mostly realized as an electroacoustic converter, e.g. a miniature loudspeaker, or as an electromechanical converter, e.g. a bone conduction receiver. The amplifier is usually integrated into a signal processing unit. This basic structure is shown in the example in FIG. 1 of a behind-the-ear hearing device. One or more microphones 2 for recording the ambient sound are incorporated in a hearing device housing 1 to be worn behind the ear. A signal processing unit 3, which is similarly integrated into the hearing device housing 1, processes the microphone signals and amplifies them. The output signal of the signal processing unit 3 is transmitted to a loudspeaker and/or receiver 4, which outputs an acoustic signal. The sound is optionally transmitted to the ear drum of the device wearer via a sound tube, which is fixed with an otoplastic in the auditory canal. The power supply of the hearing device and in particular of the signal processing unit 3 is supplied by a battery 5 which is likewise integrated into the hearing device housing 1.

A signal processing unit of a hearing device can also be configured to reduce unwanted interference noise in a microphone signal of the hearing device. Such a noise reduction allows an auditory quality of the acoustic signal output by the hearing device to be improved. An interference noise can originate for instance from noise sources in the surroundings of the device wearer. It is therefore detected by the microphones of the hearing device together with the sound which is to be processed as useful sound for the device wearer by the hearing device.

A noise reduction takes place in many cases in that an attenuation factor is continuously calculated for an input signal, in other words a microphone signal or also for individual spectral components of the microphone signal. In such cases an attenuation factor can have a value between 0 and 1. A smaller value always results if an interference noise dominates in an input signal of the noise reduction. In such cases an attenuation factor is often calculated on the basis of an estimated value for a signal-to-noise ratio. An example of such a noise reduction is the Wiener filter.

An improved output signal finally results if the input signal is multiplied with the corresponding attenuation factor. A corresponding value for an attenuation can also be determined for algorithms for noise reduction, in which an attenuation factor is not calculated expressly. This value is then produced as the ratio of a value of an output signal generated by the noise reduction to the corresponding value of the input signal.

Different methods are known for the reduction of an interference noise in a microphone signal. It is common to all methods that a distinction must be made between a useful sound and a noise.

An effective distinction can be made in many instances between a useful sound and a noise, if a check is carried out for an input signal to determine whether the input signal is stationary in the statistical sense. Many noises, e.g. air conditioning noise, often only change their statistical properties very slowly compared with a voice of a speaking person for instance. It is therefore assumed with this method that stationary sections of the input signal are to be assigned to unwanted interference noises and can be attenuated accordingly.

The disadvantage of such noise reduction for stationary interference noises is however in that non-stationary noises can only be attenuated poorly therewith. Non-stationary interference noises are referred to here as instationary interference noises. One example of an instationary noise is the banging of a closing door or the rattling of items of crockery against one another. A further disadvantage of many methods for reducing stationary interference noises is that in the case of instationary interference noises, they generate unwanted artifacts in the processed signal.

Another possibility of making a distinction between a useful sound and a noise is used in the arrangement containing several microphones. A direction of incidence can thus be determined, from which a sound or spectral components of a sound strike the arrangement. A distinction is then made between the useful sound sources and interference sound sources as a function of the direction of incidence.

To ensure that a direction of incidence of a sound can be determined, the sound must however be spatially oriented. In other words, sound waves of the sound must allow a propagation direction to be identified. It is only then that a spatial position of a sound source in respect of the microphone arrangement can be assigned to a sound. An assignment becomes increasingly more difficult, the more the echo mixes with a direct sound of the sound source. Considerable echo develops in particular in closed rooms. One disadvantage of a noise reduction for spatially oriented interference noises is that they are only suited to interference noises, for which a direction of incidence of the interference noise can be determined.

SUMMARY OF THE INVENTION

It is accordingly an object of the invention to provide a hearing apparatus and a method for reducing an interference noise for a hearing apparatus which overcome the above-mentioned disadvantages of the prior art methods and devices of this general type, which provides improved noise reduction for the hearing apparatus, with which both stationary and also non-stationary interference noises can be attenuated in an input signal of the hearing apparatus.

The inventive hearing apparatus contains a first reduction facility for reducing stationary interference noises of an input signal and a second reduction facility for reducing interference noises which are spatially orientated in respect of the hearing apparatus. The hearing apparatus further contains a selection facility for selecting the first and/or second reduction facility for an output signal to be formed from the input signal.

With such a hearing apparatus, a method associated with the invention of reducing an interference noise for a hearing apparatus can be used. The method includes the steps of: analyzing an input signal, selecting between or combining a noise reduction for stationary interference noises and a noise reduction for spatially orientated interference noises as a function of the result of the analysis, and generating an output signal from the input signal via the selected noise reduction or the combined noise reductions.

The hearing apparatus and the method for reducing an interference noise can advantageously attenuate stationary interference noise with a noise reduction for stationary interference noises which is configured especially therefor. It is however also possible, if the noise reduction for stationary interference noises is unsuited to attenuating a certain interference noise, to revert back to the advantages of a noise reduction for spatially orientated interference noises.

The knowledge underlying the invention is that an instationary interference noise in particular can often be more effectively attenuated with a reduction facility for reducing spatially oriented interference noises than is possible with a reduction facility for reducing stationary interference noises.

An inventive hearing apparatus is advantageously developed such that the selection facility makes a selection between the reduction facilities as a function of a criterion for the stationarity of the input signal. A criterion for the stationarity may simply concern information detailing whether or not an input signal is stationary in the statistical sense. The criterion may however also concern a continuous measure.

In accordance with the hearing apparatus, the inventive method can be advantageously developed by the input signal being analyzed in respect of its stationarity.

By determining a stationarity of the input signal, a particularly reliable decision can be made to determine whether a noise reduction for stationary interference noises or a noise reduction for spatially oriented interference noises produces an output signal with an improved auditory quality.

An inventive hearing apparatus is advantageously developed if the selection facility evaluates a value of an attenuation factor of the first reduction unit or an estimated value for a signal-to-noise ratio of the first reduction unit as a criterion for the stationarity. The inventive method can also be developed accordingly. Evaluation of the attenuation factor or estimation of the signal-to-noise ratio is advantageous in that on the basis of these variables it is possible to reliably determine if a reduction in an interference noise does not take place to a sufficient degree on the basis of the first reduction unit in order to achieve a high auditory quality.

The inventive hearing apparatus is also advantageously developed if the two reduction facilities and the selection facility are configured to implement the respective reduction and to select several different frequency bands in each instance. Consequently, a particularly high auditory quality of the output signal results. The inventive method can be developed accordingly.

A further advantage results if, in the case of the inventive hearing apparatus, the attenuation factor of the first reduction unit is limited to small values by an anchor gain value and if an attenuation can be generated by the second reduction unit, the attenuation corresponding to a value for an attenuation factor which is smaller than the anchor gain value. Anchor gain value is understood to mean a minimal value, which is always used for attenuation instead of the attenuation factor of the first reduction facility, if a calculation for this attenuation factor produces a smaller value than the anchor gain value in accordance with an algorithm for a noise reduction. By using an anchor gain value for the attenuation factor of the first reduction unit and at the same time permitting smaller values for the attenuation by the second reduction unit, the hearing apparatus is able to effectively attenuate both stationary and also instationary interference noises in an input signal, without the auditory quality of the output signal being negatively affected by artifacts produced by the noise reduction when this is done. A corresponding development of the inventive method is likewise possible.

The inventive hearing apparatus is also advantageously developed by, in the case of the hearing apparatus, if a change from one of the two reduction facilities to the other reduction facility results from the selection, the selection facility is fading from the one reduction facility to the other reduction facility. The term fading here is understood to mean that a non-instantaneous change takes place for instance from the second reduction unit to the first reduction unit if the input signal initially behaved in an instationary fashion and it is identified that it is now behaving in a stationary fashion. Instead of an instantaneous changeover or also switchover, the fading process instead causes attenuation factors of both reduction units or output signals calculated with both reduction units to be mixed during a temporally limited transition for instance. A mixing can take place for instance by a weighted addition. The inventive method can be developed accordingly.

Audible switchover effects are reduced when changing between both reduction units by fading.

A further advantageous development of the inventive hearing apparatus finally consists of the second reduction facility being configured to attenuate signals of a sound, if the sound strikes the hearing apparatus from a predetermined direction. Accordingly, the inventive method is advantageously developed such that the noise reduction for spatially oriented interference noises attenuates signals of a sound if the sound is received from a predetermined direction.

A predetermined direction is advantageous in that artifacts in the output signal are avoided for the noise reduction for spatially oriented interference noises. This contributes to a high auditory quality of the output signal.

Other features which are considered as characteristic for the invention are set forth in the appended claims.

Although the invention is illustrated and described herein as embodied in a hearing apparatus and a method for reducing an interference noise for a hearing apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
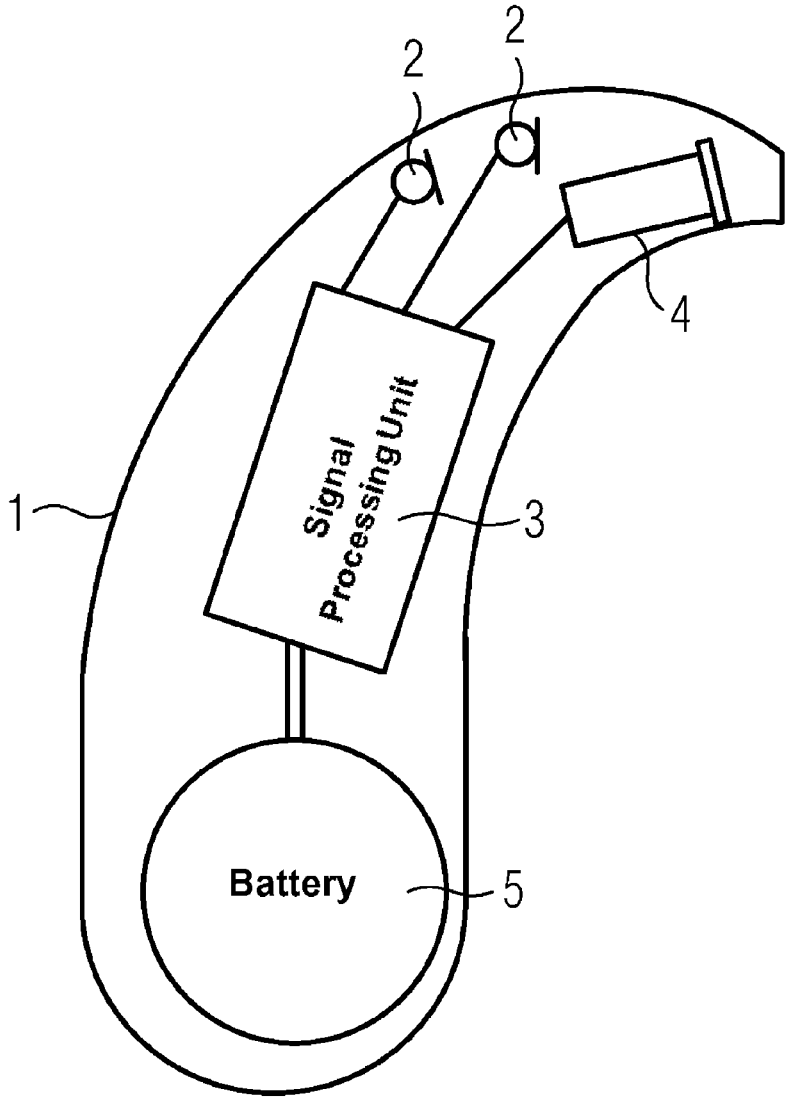
FIG. 1 PRIOR ART
FIG. 1 is an illustration of a representation of a schematic structure of a part of a behind-the-ear hearing device according to the prior art.
Figure 2:
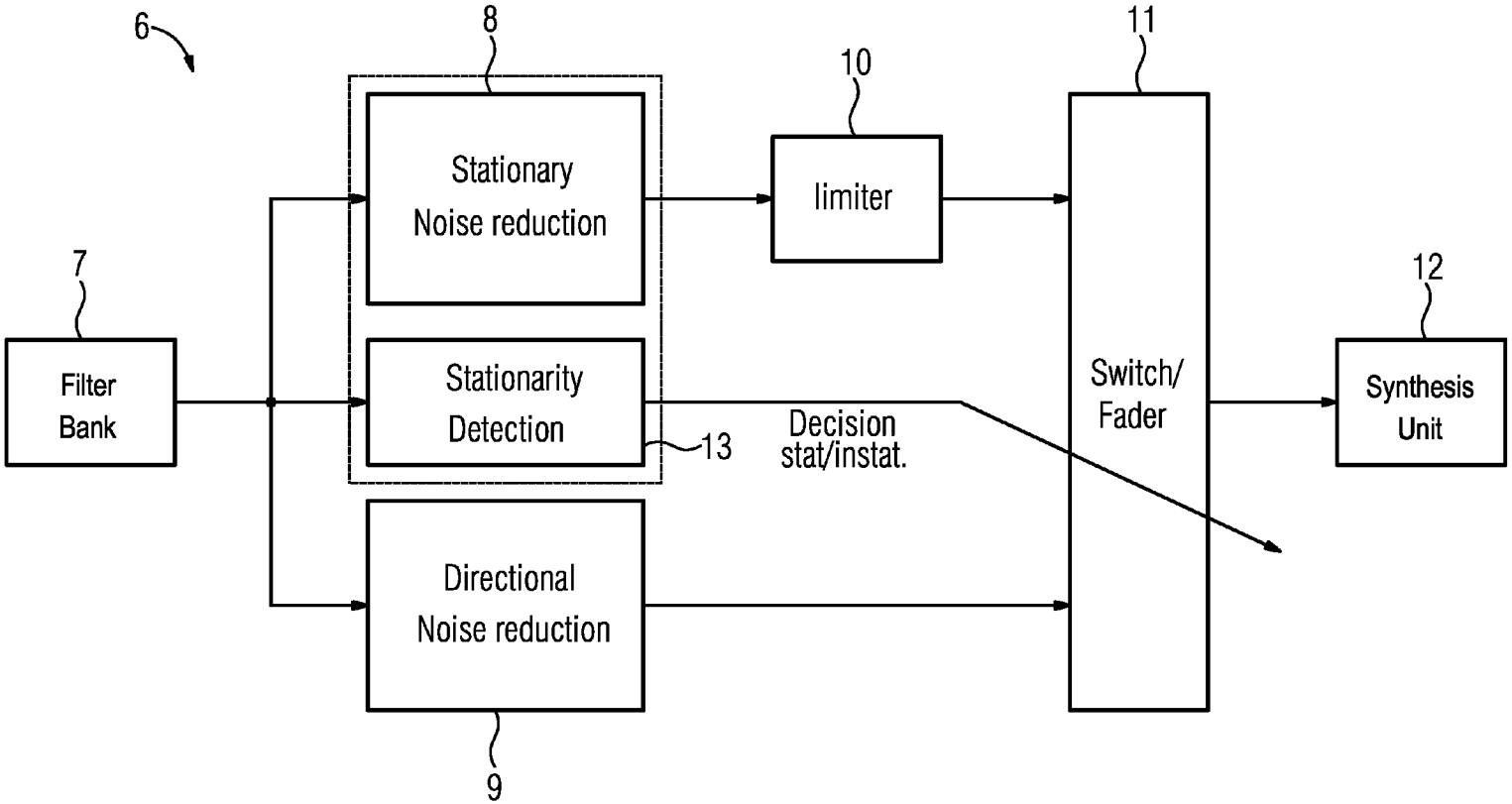
FIG. 2 is a signal flow chart for a hearing device according to an embodiment of an inventive hearing apparatus.

Referring now to the figures of the drawing in detail and first, particularly, to FIG. 2 thereof, there is shown how an output signal is generated in a hearing device, which is not shown in further detail in FIG. 2, from an input signal via signal processing 6. A noise is reduced with the output signal, the noise being contained in the input signal.

The input signal for the signal processing 6 is broken down by a filter bank 7 into its spectral parts. Therefore parts of the input signal contained therein are determined for different frequency bands. The values for the determined spectral parts are transferred to a noise reduction unit 8 for stationary noises and a noise reduction unit 9 for spatially oriented noises. In the example in FIG. 2, the spectral parts are processed by the signal processing 6 independently of one another. FIG. 2 therefore only shows the signal flow chart for values of an individual spectral part. This is symbolized by simple connecting lines between the blocks of the signal flow chart. The remaining spectral parts are processed in a comparable manner during signal processing 6.

An attenuation factor is calculated by the noise reduction unit 8 for stationary noises, the attenuation factor being adjusted over time as a function of the input signal. The calculated attenuation factor is set to an anchor gain value by a limiter 10, if the calculated attenuation factor is less than the anchor gain value. In the example the anchor gain value effects an attenuation of 10 dB. In other words, an amplification of the input signal of −10 dB results from the anchor gain value. The attenuation factor output by the limiter 10 and possibly corrected is calculated with the input signal. FIG. 2 therefore shows the output of the limiter 10 as a processed signal.

The method used in the noise reduction unit 8 for calculating the attenuation factor generates, in combination with the limiter 10, an artifact-free, quiet sound impression of the processed signal such that the reduction does not fall below a defined lower limit, namely the anchor gain value, for stationary interference sound. In the case of a stationary interference sound, this maximum value of the reduction is also generally reached so that an almost constant attenuation is produced. This brings about the quiet sound impression.

The noise reduction unit 9 for spatially oriented interference noises is able to attenuate the signal of a sound particularly effectively, the sound striking the device wearer from the rear. At the same time, the signal of a sound source remains unattenuated through the noise reduction unit 9, if the device wearer turns to face this sound source. The sound then strikes the device wearer from the front.

The input signal is a multichannel signal. It is composed of several microphone signals of a microphone arrangement of the hearing device. FIG. 2 does not clearly show that the connecting lines between the blocks of the signal flow chart can involve multichannel connections.

The directionally-dependent attenuation through the noise reduction unit 9 is achieved by so-called beam forming, which combines mutually corresponding spectral parts of the different channels with one another. The attenuation of an interference noise effected by the noise reduction unit 9 can amount here in particular to more than 10 dB. In the case of the noise reduction unit 9, the attenuation is therefore not restricted. In the example in FIG. 2, the noise reduction unit 9, like the limiter 10, emits a processed signal, which is single-channel.

An output signal is formed from the two processed signals, namely that of the limiter 10 and that of the noise reduction unit 9, by a mixing device 11. This output signal is then converted into an audio signal by a synthesis unit 12.

The mixer 11 is controlled by an analysis unit 13. The analysis unit 13 examines every spectral part of the input signal to determine whether or not it is stationary in a statistical sense. For time segments, for which the spectral part is stationary, the mixer 11 is controlled such that only the processed signal of the limiter 10 is output to the synthesis unit 12 as an output signal. If a spectral part is by contrast instationary, the mixer 11 switches to the output of the noise reduction unit 9. If a changeover then results from the output of the noise reduction unit 9 back to the limiter 10, it is not easy to switch back. Instead, the analysis unit 13 controls the mixer such that a gradual fade from the output of the noise reduction unit 9 to the output of the limiter 10 takes place within a time frame of one second here.

The analysis unit 13 not only examines the spectral parts of the input signal. The attenuation factor calculated by the noise reduction unit 9 is also observed. This is symbolized in FIG. 2 by a dashed box. If the attenuation factor for a spectral part has a value smaller than or equal to the anchor gain value, the analysis unit 13 indicates that the spectral part is stationary. Accordingly, a decision is made relative to the instationarity as to if the attenuation factor lies above the anchor gain value. As the signal of the filter bank 7 is also observed directly by the analysis unit 13, further analysis steps can take place in order to check the analysis implemented on the basis of an observation of the attenuation factor once again.

The five diagrams in FIGS. 3A-3E show timing curves of a variable in each instance, such as are produced for a hearing device not shown in FIGS. 3A-3E. Horizontal time axes are scaled identically in FIGS. 3A-3E, so that temporally identical changes to the variables in FIGS. 3A-3E lie on a shared vertical axis.

Figure 3A:
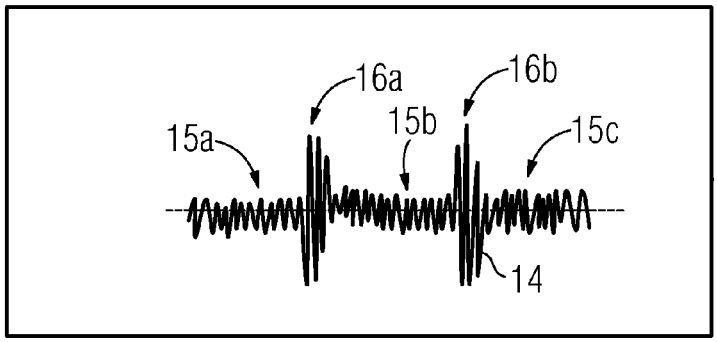
FIGS. 3A-3E are diagrams, in which a timing curve of a variable is shown in each instance, with all curves being produced for a hearing device in accordance with a further embodiment of an inventive hearing apparatus.

FIG. 3A shows a timing curve of a spectral part 14 of a microphone signal, which originates from one of several microphones of the hearing device. The timing curve of the spectral part represents an input signal within the meaning of the invention. The spectral part 14 behaves in a stationary fashion, in a statistical sense, in all three time segments 15*a*, 15*b*, 15*c*. In time segments 15*a*, 15*b*, 15*c*, the spectral part namely has a constant statistical average value and an identical variance. The microphone signal is predominantly determined by a ventilator for the time segments 15*a*, 15*b*, 15*c*, the consistent noise of which is detected by the microphones of the hearing device.

In two time segments 16*a*, 16*b*, the stationary signal of the ventilator noise is drowned out by a sound signal in each instance. Consequently, an instationary curve of the spectral part 14 is produced overall for the time segments 16*a*, 16*b*.

The first sound signal, which is detected in time segment 16*a*, is the speech signal of a speaker. The speaker is opposite a wearer of the hearing device. The voice of the speaker therefore strikes the conventionally-worn hearing device from the front. The instationary curve during the time segment 16*b* is caused by the slamming of a door, which shuts behind the wearer of the hearing device. The sound generated by the shutting door therefore strikes the hearing device from the rear.

Figure 3B:
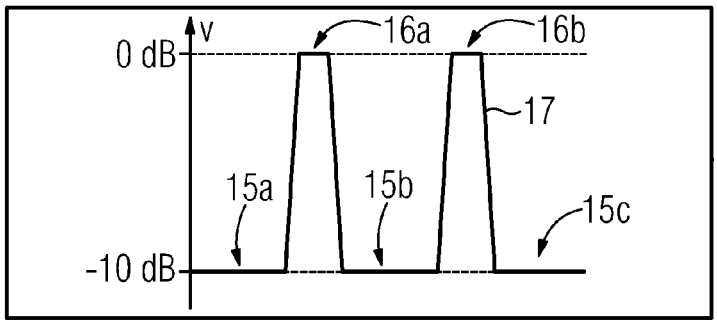

A curve 17 of an amplification V is shown in FIG. 3B, as is effected by a noise reduction located in the hearing device for stationary interference noises for the spectral part 14. An attenuation factor of the noise reduction is delimited downwards to an anchor gain value by a limiter. As a result, a minimal value of the amplification V of −10 dB is produced. The amplification V in the time segments 15*a*, 15*b*, 15*c* has this minimal value, if spectral part 14 behaves in a stationary fashion. In the time segments 16*a*, 16*b*, for which the spectral part 14 behaves in an instationary fashion, the noise reduction for stationary noises barely brings about any attenuation. The spectral part 14 is unattenuated, i.e. is allowed to pass through the noise reduction for stationary interference noises with an amplification V of approximately 0 dB.

Figure 3C:
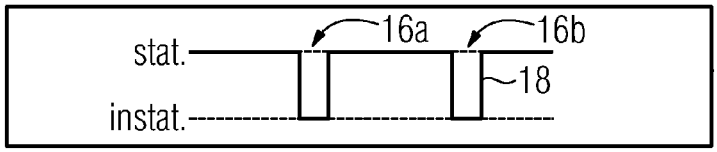
Figure 3D:
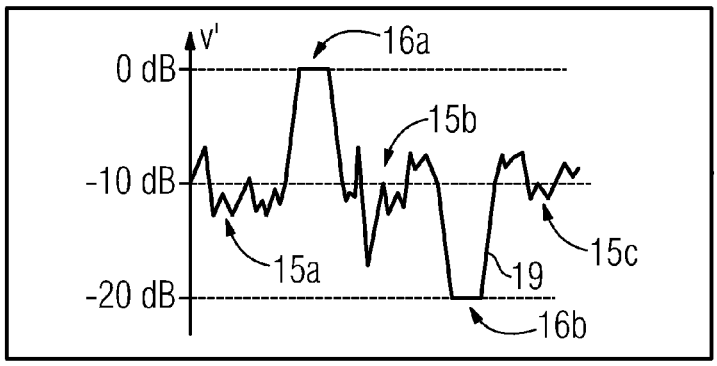

FIG. 3C shows an analysis result 18 of an analysis unit, which is similar to the analysis unit 13 shown in FIG. 2. The analysis unit correctly detected that the spectral part 14 in the time segments 16*a* and 16*b* behaves in an instationary fashion. The analysis result 18 therefore changes for the time segments 16*a* and 16*b* from "stationary" to "instationary". In FIG. 3C, both possible analysis results are abbreviated to "stat" and "instat". The analysis result 18 relates here to the curve 17 of the amplification V. The analysis result 18 shows that the curve of the spectral part 14 is subdivided here into two mutually exclusive classes, namely into time segments 15*a*, 15*b*, 15*c*, in which the signal is classified as stationary and into time segments 16*a*, 16*b*, in which the signal is classified as instationary. A curve 19 of an amplification V' is shown in FIG. 3D, by which curve a noise reduction which is likewise present in the hearing device is effected for spatially oriented interference noises in the spectral part 15. This second method for noise reduction does not attenuate a signal of a sound, which strikes the wearer of the hearing device from the front. By contrast, a signal of a sound, which strikes the wearer of the hearing device from the rear, is attenuated by up to 20 dB for spatially oriented interference noises as a result of a cardioid characteristic of a beam former of the noise reduction. A lower limit can however also be provided for the noise reduction for spatially oriented interference noises. Interferences noises can lie at −18 dB for these limits for instance.

Unlike the amplification V, the amplification V" is not restricted to small values. It may therefore also fall to below −10 dB. Its curve is therefore also not constant for those time segments 15*a*, 15*b*, 15*c* in which the spectral part 14 is stationary. The curve 19 is non-uniform in the time segments 15*a*, 15*b*, 15*c*, because an echo in the surroundings of the device wearer result in the noise of the ventilator striking the microphone of the hearing device from a constantly changing direction.

The speech signal of the speaker, which, in time segment 16*a*, strikes the hearing device from the front, is not audibly changed by the noise reduction for spatially oriented interference noises. The amplification V' for the time segment 16*a* namely amounts to 0 dB. By contrast, the slamming of the door, which, in time segment 16*c*, strikes the wearer of the hearing device from the rear, is effectively suppressed by −20 dB with an amplification V'.

Figure 3E:
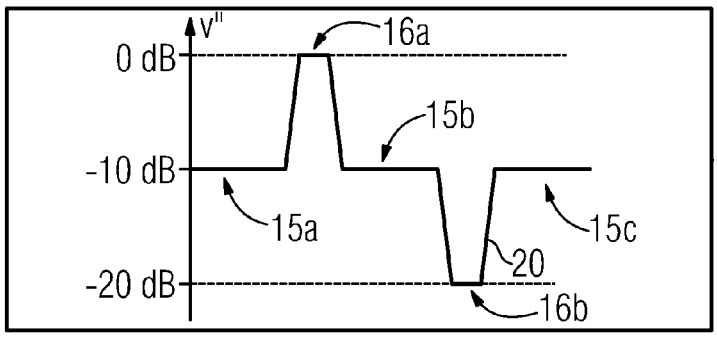

FIG. 3E shows a curve 20 of a total amplification V", which results during the processing of the spectral part by the signal processing 6. The processed spectral part is combined together with the spectral parts processed in parallel to form an output signal, from which a sound signal for the wearer of the hearing device is formed by the hearing device. The curve 20 results from a selection between the results of the noise reduction, by which the amplification V is effected, and the noise reduction, by which the amplification V' is effected. The selection is made in accordance with the analysis result 18. In this way, the noise reduction for stationary interference noises is selected for the time segments 15*a*, 15*b* and 15*c*, so that an approximately constant amplification of −10 dB results for the total amplification V". The noise reduction for spatially oriented interference noises is selected for the time segments 16*a* and 16*b*. Accordingly, a very effective attenuation results for the slamming of the door in time segment 16*b*. The amplification V" then namely amounts to −20 dB. By contrast, the speech signal, which is detected during the time segment 16*a*, is not distorted, so that the wearer of the hearing device can easily understand the speaker.

No restriction therefore results in terms of small values for the total amplification V". The amplification for stationary sounds consequently proceeds continuously toward a fixed value, namely the restriction of currently −10 dB for the noise reduction for stationary interference noises. This restriction therefore forms an anchor for the total amplification V" in the event of stationary interference noises. Based on the anchor value, the total amplification V" can reject excessively high values, if an instationary sound comes from the front. Similarly, it can however also be changed toward smaller values if an instationary sound comes from the rear. A lower restriction is therefore effective in the case of a stationary interference noise, but is in contrast not effective in the case of an instationary sound. This conveys a quiet sound impression to the wearer of the hearing device with, at the same time, a high attenuation for instationary interference noises.

Overall, the wearer of the hearing device therefore perceives an output signal which has a better auditory quality than with a hearing device in which only a simple noise reduction is provided.

The invention claimed is:

1. A hearing apparatus, comprising:

a first reduction unit for reducing stationary interference noises of an input signal;

a second reduction unit for reducing non-stationary interference noises oriented spatially in respect of the hearing apparatus; and a selection facility for selecting at least one of said first or second reduction units for an output signal to be formed from the input signal, said selection facility making a selection in dependence on a criterion for a stationarity of the input signal, said selection facility, as a criterion for the stationarity, selects one of a value of an attenuation factor of said first reduction unit or an estimated value for a signal-to-noise ratio of said first reduction unit, wherein the attenuation factor of said first reduction unit is restricted to small values by means of an anchor gain value and in which an attenuation can be generated by means of said second reduction unit, the attenuation corresponding to a value for the attenuation factor smaller than the anchor gain value.

2. The hearing apparatus according to claim 1, wherein said first and second reduction units and said selection facility are configured to implement a respective reduction and a selection for several different frequency bands in each instance.

3. The hearing apparatus according to claim 1, wherein, if a change from one of said first and second reduction units to the other of said first and second reduction units takes place by means of a selection, said selection facility fades from said one reduction unit to said other reduction unit.

4. The hearing apparatus according to claim 1, wherein said second reduction unit is configured to attenuate signals of a sound if the sound strikes the hearing apparatus from a predetermined orientation.

5. A method for reducing an interference noise for a hearing apparatus, which comprises the steps of:

analyzing an input signal in respect of stationarity, as a criterion for the stationarity, selecting one of a value of an attenuation factor of a first reduction unit or an estimated value for a signal-to-noise ratio of the first reduction unit, wherein the attenuation factor of the first reduction unit is restricted to small values by means of an anchor gain value and in which an attenuation can be generated by means of a second reduction unit, the attenuation corresponding to a value for the attenuation factor smaller than the anchor gain value;

combining a noise reduction for stationary interference noises and a noise reduction for non-stationary spatially oriented interference noises in dependence on a result of the analyzing; and generating an output signal from the input signal by means of the combined noise reductions.

6. The method according to claim 5, wherein signals of a sound are attenuated by means of the noise reduction for non-stationary spatially oriented interference noises, if the sound is received from a predetermined direction.

* * * * *